US009382083B2

(12) United States Patent
Hyodo

(10) Patent No.: US 9,382,083 B2
(45) Date of Patent: Jul. 5, 2016

(54) SHEET CONVEYING APPARATUS AND IMAGE FORMING APPARATUS

(71) Applicant: CANON KABUSHIKI KAISHA, Tokyo (JP)

(72) Inventor: Taisuke Hyodo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/677,010

(22) Filed: Apr. 2, 2015

(65) Prior Publication Data

US 2015/0284200 A1 Oct. 8, 2015

(30) Foreign Application Priority Data

Apr. 3, 2014 (JP) ..... 2014-076749

(51) Int. Cl.

| | |
|---|---|
| ***B65H 7/02*** | (2006.01) |
| ***B65H 85/00*** | (2006.01) |
| ***B65H 5/06*** | (2006.01) |
| ***B65H 5/36*** | (2006.01) |
| ***B65H 7/14*** | (2006.01) |

(52) U.S. Cl.

CPC ..... *B65H 7/02* (2013.01); *B65H 5/062* (2013.01); *B65H 5/36* (2013.01); *B65H 7/14* (2013.01); *B65H 85/00* (2013.01); *B65H 2404/611* (2013.01); *B65H 2511/51* (2013.01); *B65H 2553/412* (2013.01); *B65H 2553/612* (2013.01); *B65H 2553/80* (2013.01); *B65H 2701/1311* (2013.01); *B65H 2701/1313* (2013.01)

(58) Field of Classification Search

CPC ..... B65H 7/02; B65H 7/04; B65H 2553/61; B65H 2553/612; B65H 2553/81

See application file for complete search history.

(56) References Cited

U.S. PATENT DOCUMENTS

| | | | | |
|---|---|---|---|---|
| 5,923,140 | A | 7/1999 | Azumi et al. | |
| 7,063,315 | B2 * | 6/2006 | Lyu et al. | B65H 1/12 271/110 |
| 9,061,850 | B2 * | 6/2015 | Watatani | B65H 7/14 |
| 2005/0189709 | A1 * | 9/2005 | Bokelman | B65H 7/14 271/265.01 |
| 2009/0066006 | A1 * | 3/2009 | Lee | B65H 7/04 271/8.1 |
| 2010/0278572 | A1 * | 11/2010 | Nakajima | B65H 7/02 399/381 |
| 2010/0301550 | A1 * | 12/2010 | Muratani | B65H 7/06 271/264 |
| 2012/0099875 | A1 * | 4/2012 | Yagi | B65H 29/14 399/16 |
| 2012/0219337 | A1 * | 8/2012 | Endo | B65H 5/062 399/381 |
| 2013/0264768 | A1 * | 10/2013 | Araishi | B65H 7/02 271/264 |
| 2014/0353907 | A1 * | 12/2014 | Hara | B65H 1/04 271/162 |

FOREIGN PATENT DOCUMENTS

| | | |
|---|---|---|
| JP | 06094444 A | 4/1994 |
| JP | 10114446 A | 5/1998 |

* cited by examiner

*Primary Examiner* — Jeremy R Severson

(74) *Attorney, Agent, or Firm* — Fitzpatrick, Cella, Harper & Scinto

(57) ABSTRACT

A sheet conveying apparatus includes a moving member, and a sensor detecting the sheet based on the move of the moving member. The moving member moves in a direction approaching a first position from a second position before a rear end of the sheet passes through the moving member after moving from the first position to the second position by being pressed by the sheet.

11 Claims, 11 Drawing Sheets

SHEET CONVEYING APPARATUS AND IMAGE FORMING APPARATUS

BACKGROUND OF THE INVENTION

1. Field of the Invention

This disclosure relates to a sheet conveying apparatus conveying a sheet and an image forming apparatus.

2. Description of the Related Art

In the related art, an image forming apparatus such as a copier, a printer, or a facsimile includes a sheet conveying apparatus which conveys sheets. A sheet is conveyed to an image forming portion by the sheet conveying apparatus, and a toner image formed on a photoconductive drum is transferred onto the sheet. The sheet onto which the toner image has been transferred is conveyed to a fixing portion and is then conveyed to a discharging portion.

In a sheet conveying apparatus of the related art, when a sheet is conveyed, switching operations in various switching portions, switching operations of rotation directions in a sheet conveying portion, or the like are performed on the basis of detection of a front end of the sheet. A sheet detection portion which detects passage of the sheet is provided on a sheet conveying path in order to detect the front end of the sheet. By providing a plurality of sheet detection portions, it is possible to also detect, for example, conveyance delay or jamming of sheets.

Here, there is a sheet detection portion including a sensor flag (moving member) and an optical sensor. In such a sheet detection portion, if the sensor flag is pushed and rotated by a sheet and is thus moved to a detection position so as to be detected by the optical sensor, a control portion detects that the sheet has been conveyed on the basis of a signal from the optical sensor which detects the sensor flag. If a rear end of the sheet has passed through the sensor flag, the sensor flag is returned from the detection position to a standby position where the sensor flag can abut on a sheet to be conveyed, by a biasing force of a biasing portion. The sensor flag returned to the standby position abuts on a stopper portion so as to be positioned at the standby position.

However, when the sensor flag is positioned by the stopper portion, the sensor flag flips and causes chattering due to an impact when abutting on the stopper portion, and thus it takes a certain time for the sensor flag to be positioned at the standby position. For this reason, in the related art, as disclosed in JP-A-6-94444, for example, an impact absorbing material is provided on an abutting surface of the sensor flag abutting on the stopper portion, and thus the flipping of the sensor flag is minimized. As disclosed in JP-A-10-114446, an abutting surface of the sensor flag abutting on the stopper portion is tilted, and thus repulsive energy generated on the abutting surface is released in a thrust direction.

Meanwhile, in recent years, there has been a demand for improvement in the productivity, that is, improvement in the number of sheets on which images are formed in the image forming apparatus per unit time. For this reason, a sheet conveyance speed has been increased, or an interval (sheet interval) between a rear end of a sheet and a front end of the next sheet, the sheets being continuously conveyed, has been reduced. In order to reduce a sheet interval, in a sheet detection apparatus, the sensor flag is required to be returned to the standby position from the detection position in a short period of time after a preceding sheet passes.

Here, for example, if a biasing force of the biasing portion is increased, the sensor flag can be returned to the standby position in a short period of time. However, if a biasing force of the biasing portion is increased as mentioned above, an impact when abutting on the stopper portion is increased, and thus it takes time for the sensor flag to be positioned at the standby position, that is, the time required to be able to detect a distal edge of a sheet is lengthened.

SUMMARY OF THE INVENTION

According to an aspect of this disclosure, there is provided a sheet conveying apparatus including a moving member moving from a first position to a second position by being pressed by a conveyed sheet, and a sensor detecting the sheet based on the move of the moving member. The moving member moves in a direction approaching the first position from the second position before a rear end of the sheet passes through the moving member after moving from the first position to the second position by being pressed by the sheet.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
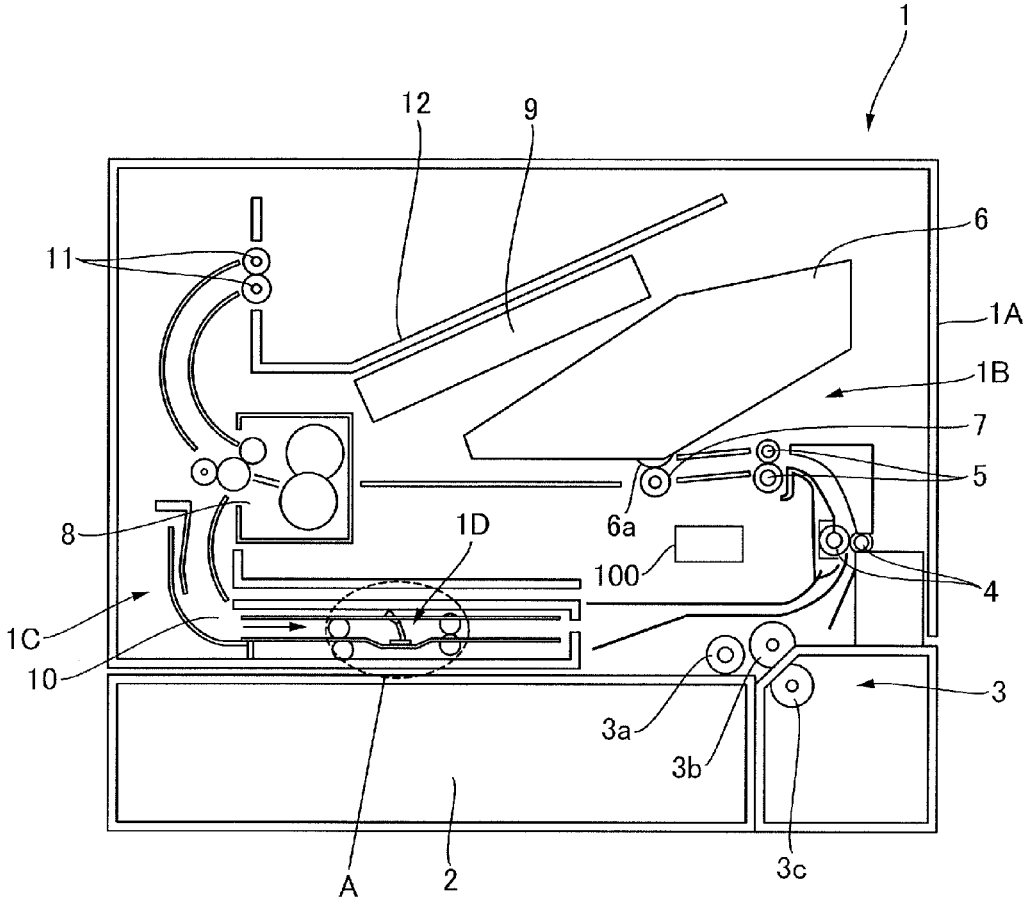
FIG. 1 is a diagram illustrating a schematic configuration of a laser printer as an example of an image forming apparatus including a sheet conveying apparatus according to a first embodiment of this disclosure.

Hereinafter, embodiments of this disclosure will be described in detail with reference to the drawings. FIG. 1 is a diagram illustrating a schematic configuration of a laser printer as an example of an image forming apparatus including a sheet conveying apparatus according to a first embodiment of this disclosure. In FIG. 1, the reference numeral 1 indicates a laser printer, and the reference numeral 1A indicates a laser printer main body (hereinafter, referred to as an apparatus main body). A sheet feeding apparatus 3 which feeds a sheet to an image forming portion 1B is provided on a lower part of the apparatus main body 1A. The reference numeral 1C indicates a sheet conveying apparatus which conveys a sheet of which an image is formed on one surface to the image forming portion 1B again in order to form an image on the other surface of the sheet.

The image forming portion 1B includes a cartridge unit 6 provided with a photoconductive drum 6*a* as an image carrier, and a laser scanner 9 which exposes the photoconductive drum 6*a* to light. When an image is formed, the photoconductive drum 6*a* is exposed to light by the laser scanner 9 such that a latent image is formed on a photoconductive drum surface, and then the latent image is developed, thereby allowing a toner image to be formed on the photoconductive drum surface.

The sheet feeding apparatus 3 includes a sheet feeding cassette 2 as a sheet stacking portion which is attachably and detachably provided in the apparatus main body 1A, and a sheet feeding roller 3*a* which is provided over the sheet feeding cassette 2 and feeds a sheet stored in the sheet feeding cassette 2. In addition, the sheet feeding apparatus 3 includes a feed roller 3*b* and a retard roller 3*c* constituting a separating unit which separates sheets fed by the sheet feeding roller 3*a* from each other. The reference numeral 100 indicates a control portion which controls an image forming operation in the image forming portion 1B, a sheet conveying operation in the sheet conveying apparatus 1C, and the like.

The sheet feeding apparatus 3 configured as mentioned above feeds sheets stored in the sheet feeding cassette 2 by using the sheet feeding roller 3*a* in parallel to a toner image forming operation in the above-described image forming portion 1B. The sheets are separated one by one by the feed roller 3*b* and the retard roller 3*c*. Next, the sheet is conveyed to a registration roller pair 5 by a conveyance roller pair 4, and is then conveyed to a transfer portion constituted by the photoconductive drum 6*a* and a transfer roller 7, at a predetermined timing by the registration roller pair 5.

The transfer portion transfers the toner image formed on the photoconductive drum surface onto the sheet S which has been conveyed to the transfer portion, and then the sheet is conveyed to a fixing device 8. The sheet is heated and pressed in the fixing device 8 such that the toner image is fixed thereto. After the image is fixed in the above-described manner, the sheet is discharged to a discharging portion 12 provided on an apparatus main body upper surface, by a discharging roller pair 11.

On the other hand, in a case where an image is also formed on the other surface, the sheet of which an image is formed on one surface passes through the fixing device 8, and is then conveyed in a switched-back manner due to reversion of the discharging roller pair 11 so as to be fed to the sheet conveying apparatus 1C. Next, the sheet passes along a duplex path 10 and is then conveyed to the transfer portion by the registration roller pair 5 again such that a toner image is transferred onto the other surface in the transfer portion. The toner image is fixed by the fixing device 8, and the sheet is discharged to the discharging portion 12.

Figure 2:
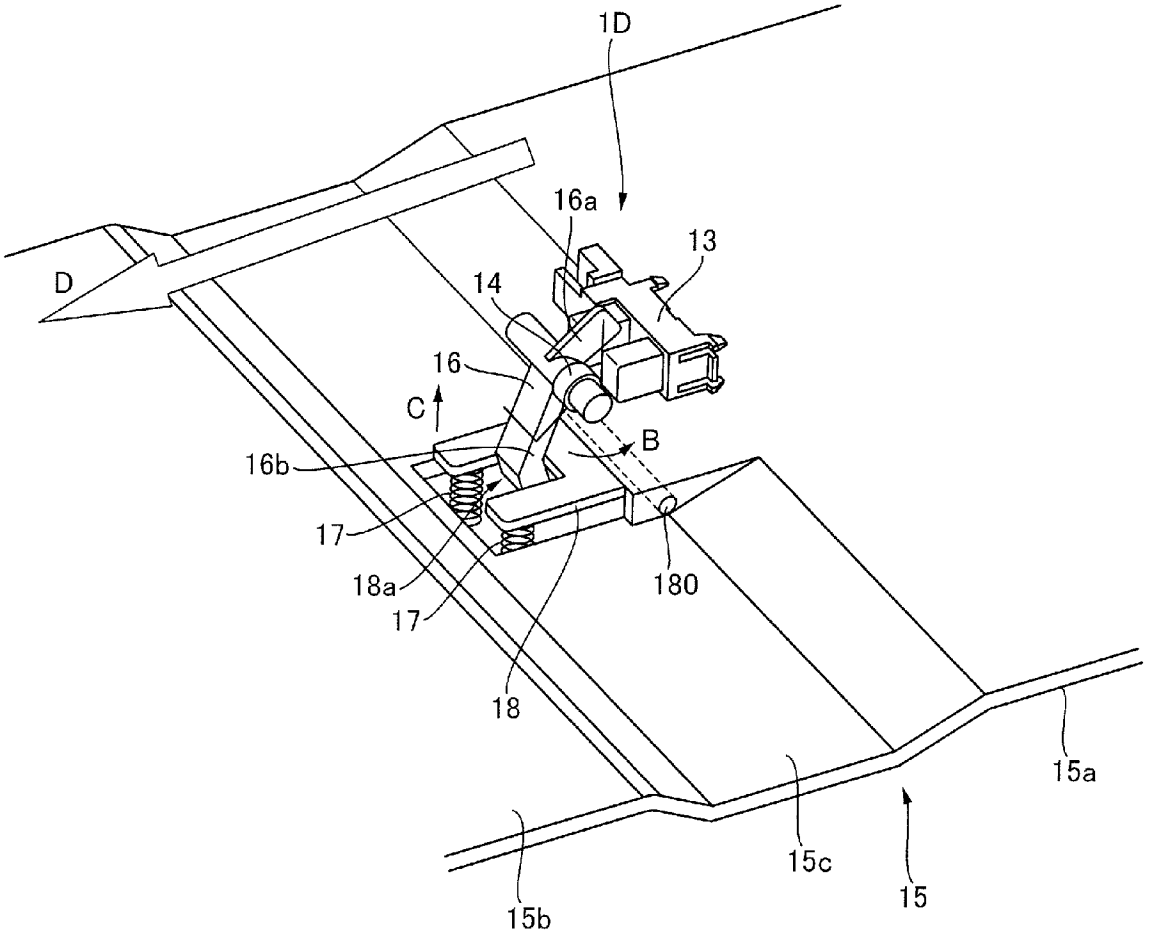
FIG. 2 is a diagram illustrating a configuration of a sheet detection portion provided in the sheet conveying apparatus.

Meanwhile, a sheet detection portion 1D which detects passage of a sheet is provided on the duplex path 10 which is a sheet conveyance path. As illustrated in FIG. 2, the sheet detection portion 1D includes an optical sensor 13, and a detection flag 16 as a moving member provided with a light blocking section 16*a* which blocks light from reaching the optical sensor 13. The detection flag 16 is biased in an arrow B direction by a biasing member 14 which is a flag biasing portion and is positioned at a home position (standby position).

In FIG. 2, the reference numeral 15 indicates a conveyance guide which forms a bottom of the duplex path 10. A sheet passing along the duplex path 10 is conveyed in an arrow D direction along the conveyance guide 15. The conveyance guide 15 includes an upstream side conveyance guide portion 15*a* provided on a side facing the detection flag (moving member) 16, a downstream side conveyance guide portion 15*b*, and a recess portion 15*c* provided between the upstream side conveyance guide portion 15*a* and the downstream side conveyance guide portion 15*b*.

The reference numeral 18 indicates a movable guide provided at the recess portion 15*c* of the conveyance guide 15. That is, the movable guide 18 is provided on a side opposite the detection flag 16 and configured to be movable in a direction away from the detection flag 16. The movable guide 18 is pivotably (movably) supported at a downstream end of the upstream side conveyance guide portion 15*a* in the sheet conveyance direction via a guide shaft 180. The movable guide 18 is biased upwardly as indicated by an arrow C by a biasing member 17 which is a guide biasing portion, and is thus positioned at the home position (guide position) where an upper surface thereof on which a sheet passes is paralleled with the sheet conveyance direction by a stopper portion 181 (see FIG. 3A). That is, the movable guide 18 is a support member provided within the recess portion 15*a* of the conveyance guide 15, supporting the sheet being conveyed within the recess portion 15*c*, and being movable from a support position, i.e., home position/guide position, where the support member supports the sheet in a direction approaching the conveyance guide 15. A notch portion 18*a* is provided at the movable guide 18. Typically, a distal edge portion 16*b* of the detection flag 16 is positioned in a state of entering the notch portion 18*a* which is a stopper keeping the detection flag 16 at the home position.

Figure 3A:
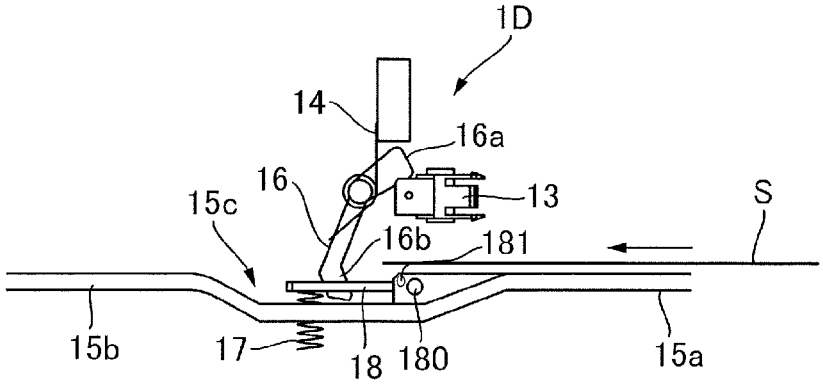
FIG. 3A is a side view illustrating a state in which a sheet is conveyed toward the sheet detection portion.
Figure 3B:
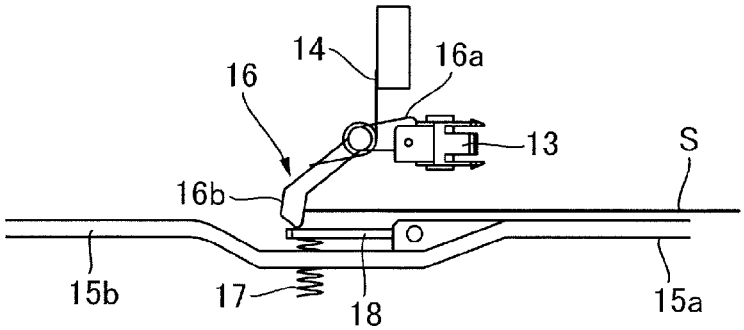
FIG. 3B is a side view illustrating a state in which a detection flag is rotated by the conveyed sheet.

Next, a description will be made of a sheet detection operation in the sheet detection portion 1D having the configuration with reference to FIGS. 3A to 3D. FIG. 3A illustrates a state in which a sheet S has not yet reached the sheet detection portion 1D, and, at this time, the detection flag 16 lies at the home position (first position) where the distal edge portion 16*b* is located under the movable guide 18. When the sheet S is guided by the upstream side conveyance guide portion 15*a* so as to reach the sheet detection portion 1D, the sheet S is guided by the movable guide 18 so as to come into contact with the detection flag 16. Then, as illustrated in FIG. 3B, the detection flag 16 which is pushed by the sheet S resists against the biasing member 14 and is moved from the home position to the detection position (second position) so as to be detected by the optical sensor 13. Here, if the detection flag 16 is moved to the detection position, the light blocking section 16*a* of the detection flag 16 blocks a light path of the optical sensor 13, and thus the control portion 100 detects that the front end of the sheet has been conveyed to the sheet detection portion 1D. That is, the control portion 100 detects the sheet based on an output signal of the optical sensor 13 as a sensor for detecting the sheet in response to a movement of the detection flag (moving member) 16.

Figure 3C:
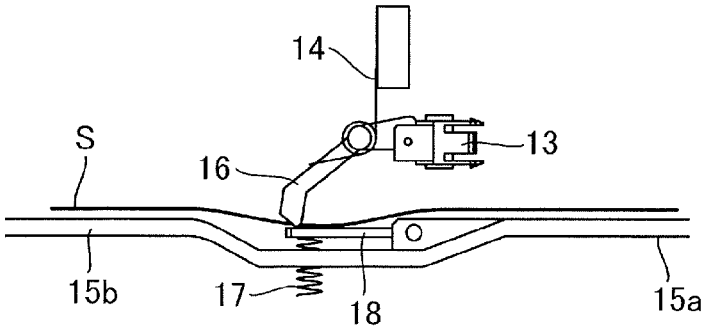
FIG. 3C is a side view illustrating a state in which the sheet passes the detection flag.

Next, if the sheet S is further conveyed, as illustrated in FIG. 3C, the sheet S gets under the detection flag 16 along the movable guide 18 and then reaches the downstream side conveyance guide portion 15*b*. Here, if the sheet S gets under the detection flag 16, a downward pressing force is applied to the sheet S by the biasing member 14 via the detection flag 16, and thus the sheet S is deflected downwardly. If the sheet S is deflected, the sheet S is pushed onto the upper surface of the movable guide 18, and the downward pressing force is also applied to the movable guide 18.

At this time, the sheet S is hung over both of the upstream side conveyance guide portion 15*a* and the downstream side conveyance guide portion 15*b* and is thus supported at both of the upstream side conveyance guide portion 15*a* and the downstream side conveyance guide portion 15*b*. For this reason, since the force applied to the sheet S by the detection flag 16 is distributed to the upstream side conveyance guide portion 15*a* and the downstream side conveyance guide portion 15*b*, an amount by which the sheet S is deflected downwardly is small, and thus a force applied to the movable guide 18 is reduced.

Figure 3D:
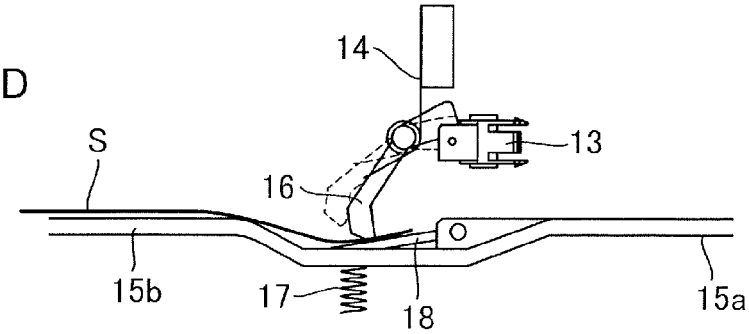
FIG. 3D is a side view illustrating a state in which a rear end of the sheet enters into a recess portion.

Next, as illustrated in FIG. 3D, if the sheet rear end which is an upstream end in the sheet conveyance direction is separated from the upstream side conveyance guide portion 15*a* and then reaches the movable guide 18, the sheet rear end is not supported any more at the upstream side conveyance guide portion 15*a*. For this reason, a force increases which is applied to the sheet S by the detection flag 16 and causes the sheet S to be deflected, and thus the force increases which is transmitted to the movable guide 18 from the detection flag 16 via the sheet S.

Consequently, the movable guide 18 is moved integrally with the detection flag 16 downwardly from the guide position where the sheet is guided to the detection flag 16, that is, in a direction becoming distant from the detection flag 16, i.e., the direction approaching the conveyance guide. That is, the movable guide 18 moves in the direction approaching the conveyance guide 15 during the sheet passing the detection flag 16 and before when the rear end of the sheet passes through the detection flag 16. In the present embodiment, the magnitude of the biasing forces of the two biasing members 14 and 17 is set in consideration of gravity such that the movable guide 18 is pushed down by the detection flag 16 if the sheet rear end is separated from the upstream side conveyance guide portion 15*a*.

Here, if the detection flag 16 pushes down the movable guide 18, the detection flag 16 is moved to the home position side (the standby position side). That is, the detection flag 16 is movable in the direction approaching the home position by pressing the movable guide 18 against a bias force of the biasing members 14 and 17 through the sheet after moving from the home position to the detection position by being pressed by the sheet. In other words, if the sheet rear end is separated from the upstream side conveyance guide portion 15*a*, the detection flag 16 is moved from the detection position (second position) to the home position (first position/standby position) side before the sheet rear end passes through the detection flag 16 and moves to an intermediate position (third position) between the home position and the detection position. That is, the detection flag 16 moves in the direction approaching to the home position from the detection position when the rear end of the sheet reaches the recess portion 15*c*. If the sheet rear end passes, the detection flag 16 returns to the home position illustrated in FIG. 3A described above.

As mentioned above, in the present embodiment, before the sheet rear end passes, the movable guide 18 is pushed down by the detection flag 16 via the sheet S, and thus the detection flag 16 is moved to the home position side in advance. That is, the detection flag 16 is capable of moving to the first position where the distal edge portion of the detection flag is positioned under an imaginary plane connecting between the upstream conveyance surface 15*a* and the downstream conveyance surface 15*b* of the conveyance guide 15, the second position where the detection flag 16 is moved in the direction away from the conveyance guide 15 by being pushed by the sheet, and the third position that is closer to the first position than the second position. The upstream and downstream conveyance surfaces 15*a* and 15*b* are located upstream and downstream, in the sheet conveying direction, of the recess portion 15*c*. Since the detection flag 16 is moved to the home position side in advance, the time required for the detection flag 16 to return to the home position can be reduced more than the time required for the detection flag 16 to return to the home position from the detection position after the sheet rear end passes.

As described above, in the present embodiment, the movable guide 18 is provided pivotably in the vertical direction, and the detection flag 16 is moved toward the home position while the movable guide 18 is pushed down via the sheet S before the sheet rear end passes through the detection flag 16. That is, the movable guide 18 moves in a direction approaching the home position (first position) from the detection position (second position) before the rear end of the sheet passes through the detection flag 16 after moving from the home position to the detection position by being pressed by the sheet. Consequently, if the sheet rear end has passed through the detection flag 16, the detection flag 16 starts to be moved from the home position side. As a result, the time required for the detection flag 16 to return to the home position after the sheet rear end passes through the detection flag 16 can be reduced more than in the configuration of the related art in which the detection flag 16 returns to the home position from the detection position after the sheet rear end passes.

Figure 4:
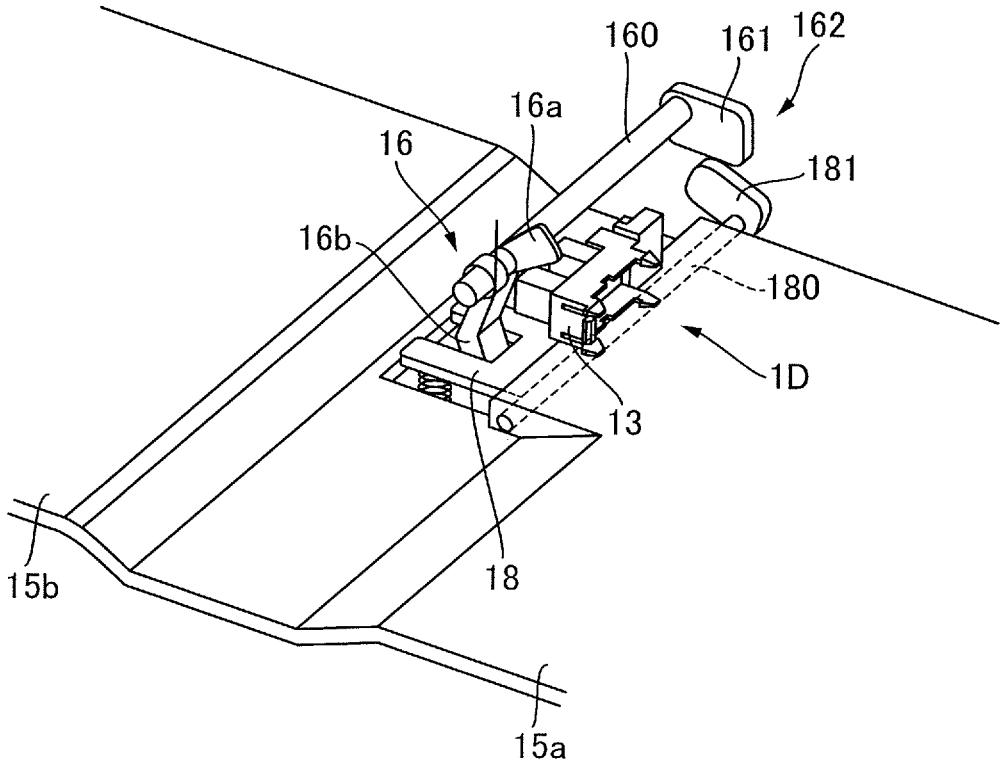
FIG. 4 is a diagram illustrating a configuration of a sheet detection portion provided in a sheet conveying apparatus according to a second embodiment of this disclosure.

Next, a second embodiment of this disclosure will be described. FIG. 4 is a diagram illustrating a configuration of a sheet detection portion 1D provided in a sheet conveying apparatus according to the present embodiment. In FIG. 4, the same reference numerals indicate similar or corresponding portions in FIG. 2 described above.

In FIG. 4, the reference numeral 160 indicates a flag shaft having the detection flag 16 installed at one end thereof, and a cam 161 is installed at the other end of the flag shaft 160. The reference numeral 181 indicates a cam installed at one end of the guide shaft 180, and the detection flag 16 and the movable guide 18 interlock with each other by a cam mechanism 162 constituted by the two cams 161 and 181.

Figure 5A:
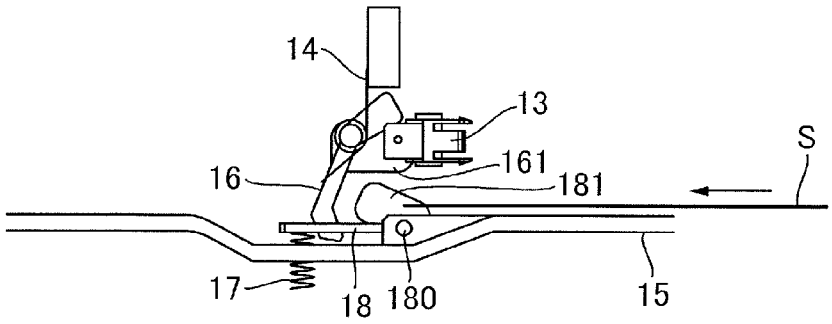
FIG. 5A is a side view illustrating a state in which the sheet is conveyed toward the sheet detection portion.
Figure 5B:
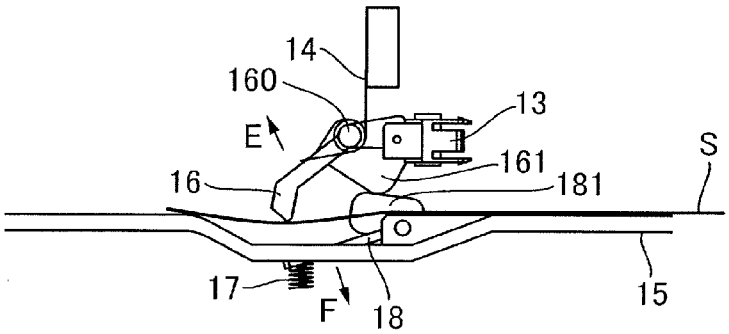
FIG. 5B is a side view illustrating a state in which a detection flag is rotated by the conveyed sheet.

Next, a description will be made of a sheet detection operation in the sheet detection portion 1D having the configuration with reference to FIGS. 5A to 5D. FIG. 5A illustrates a state in which the sheet S has not yet reached the sheet detection portion 1D, and, at this time, the detection flag 16 lies at the home position. Next, if the sheet S reaches the sheet detection portion 1D, as illustrated in FIG. 5B, the detection flag 16, which is pushed by the front end of the sheet, resists against a biasing force of the biasing member 14 and is pivotally moved to the detection position in an arrow E direction. If the sheet S is further conveyed, the sheet S is conveyed while getting under the detection flag 16.

Figure 5C:
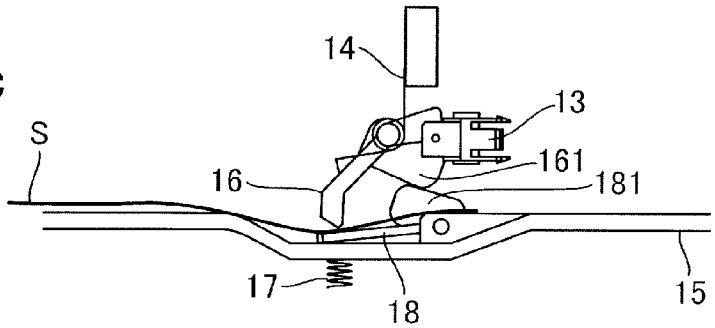
FIG. 5C is a side view illustrating a state in which a movable guide is pivoted downwardly by the detection flag.

If the detection flag 16 is pivoted, the flag shaft 160 rotates integrally with the detection flag 16, and thus the cam 161 rotates and pushes down the cam 181 of the movable guide 18 while resisting against a biasing force of the biasing member 17. Therefore, the movable guide 18 is pivoted downwardly in an arrow F direction. If the movable guide 18 is pivoted downwardly, the sheet lower surface is not supported around the detection flag 16, and thus the detection flag 16 is moved from the detection position to the home position side by a biasing force of the biasing member 14 while pushing down the sheet S as illustrated in FIG. 5C. In the present embodiment, the magnitude of the biasing forces of the biasing members 14 and 17 is set such that the detection flag 16 is pivoted downwardly while pushing down the movable guide 18 via the sheet S if the movable guide 18 is pivoted downwardly.

In other words, in the present embodiment, the movable guide 18 is pivoted downwardly by the two cams 161 and 181 before the sheet rear end passes through the detection flag 16, and thus the detection flag 16 is moved from the detection position to the home position side. If the detection flag 16 is moved to the home position side as mentioned above, the movable guide 18 is moved further upwardly than the position illustrated in FIG. 5B, by the two cams 161 and 181.

Figure 5D:
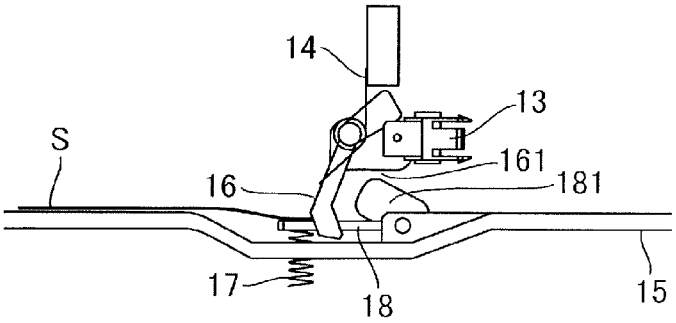
FIG. 5D is a side view illustrating a state in which the detection flag has returned to a home position.

If the rear end of the sheet S has passed, the detection flag 16 returns to the home position as illustrated in FIG. 5D. Here, since the detection flag 16 is moved to the home position side before the sheet rear end passes through the detection flag 16, it is possible to reduce the time required for the detection flag 16 to return to the home position illustrated in FIGS. 5A and 5D after the sheet rear end passes through the detection flag 16.

As described above, in the present embodiment, before the sheet rear end passes through the detection flag 16, the movable guide 18 is pivoted downwardly by using the two cams 161 and 181, and thus the detection flag 16 is moved to the home position side in advance. Consequently, in the same manner as in the above-described first embodiment, it is possible to reduce the time required for the detection flag to return to the home position after the sheet rear end passes through the detection flag more than in the related art.

Figure 6:
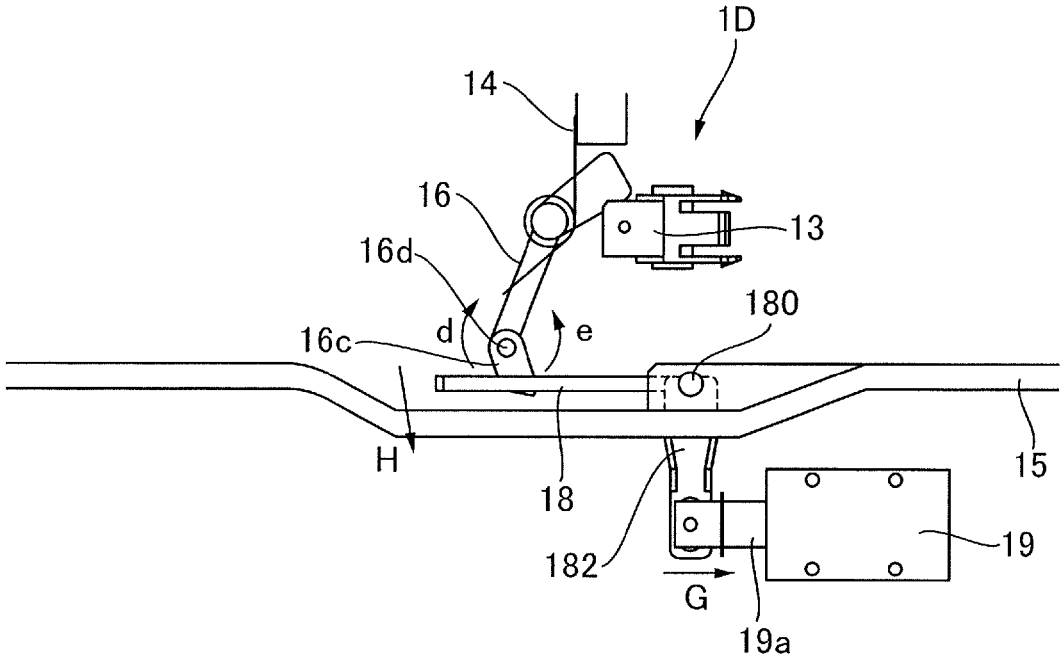
FIG. 6 is a diagram illustrating a configuration of a sheet detection portion provided in a sheet conveying apparatus according to a third embodiment of this disclosure.

Next, a third embodiment of this disclosure will be described. FIG. 6 is a diagram illustrating a configuration of a sheet detection portion 1D provided in a sheet conveying apparatus according to the present embodiment. In FIG. 6, the same reference numerals indicate similar or corresponding portions in FIGS. 3A to 3D described above.

In FIG. 6, the reference numeral 182 indicates a lever portion installed at one end of the guide shaft 180 of the movable guide 18, and the reference numeral 19 indicates a solenoid. A pin 19*a* of the solenoid 19 is connected to the lever portion 182 of the movable guide 18. If the solenoid 19 is turned on and thus the pin 19*a* is moved in an arrow G direction, the movable guide 18 is rotated with respect to the guide shaft 180 and is then moved downwardly as indicated by an arrow H.

The reference numeral 16*c* indicates an arm portion which is pivotably provided at the distal edge portion of the detection flag 16 with a pivotal shaft 16*d* as a supporting point. The arm portion 16*c* is regulated from being pivoted in an arrow d direction by a stopper (not illustrated) provided at the detection flag 16 and can be pivoted only in an arrow e direction when a distal edge portion thereof is located under the movable guide 18.

Figure 7A:
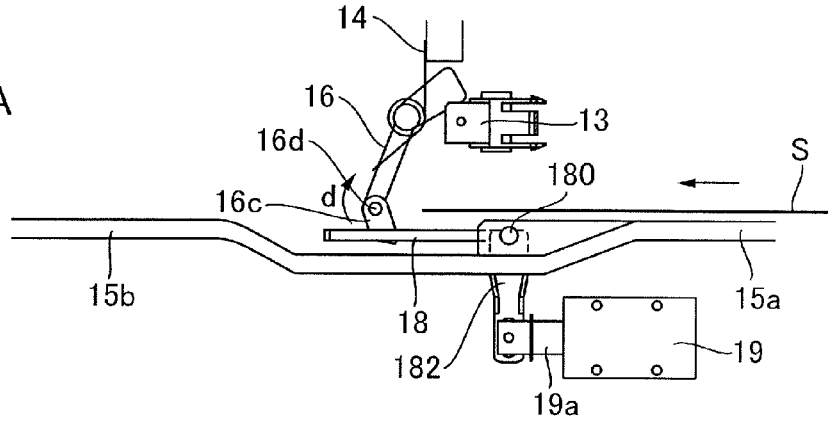
FIG. 7A is a side view illustrating a state in which a sheet is conveyed toward the sheet detection portion.

Next, a description will be made of a sheet detection operation in the sheet detection portion 1D having the configuration with reference to FIGS. 7A to 7D. FIG. 7A illustrates a state in which the sheet S has not yet reached the sheet detection portion 1D, and, at this time, the detection flag 16 lies at the home position where the distal edge portion of the arm portion 16*c* is located under the movable guide 18. Then, if the sheet S reaches the sheet detection portion 1D, the arm portion 16*c* is pushed by the front end of the sheet.

Figure 7B:
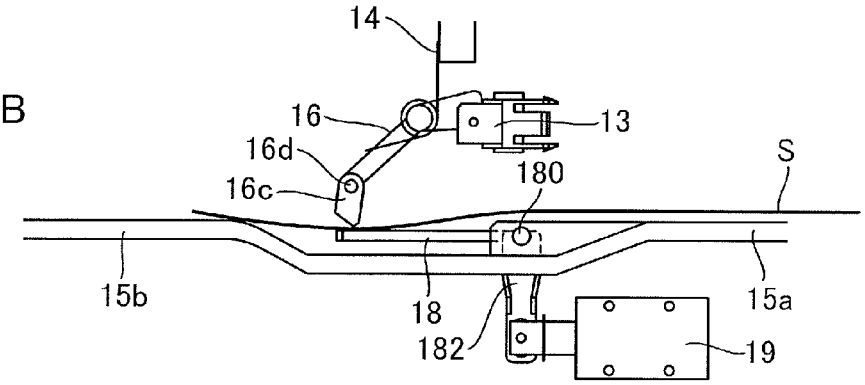
FIG. 7B is a side view illustrating a state in which a detection flag is rotated by the conveyed sheet.

In this case, since the arm portion 16*c* is regulated from being pivoted in the arrow d direction by the stopper (not illustrated), the detection flag 16 is pivoted upwardly to the detection position while resisting against a biasing force of the biasing member 14 integrally with the arm portion 16*c*. Next, if the sheet S is further conveyed, as illustrated in FIG. 7B, the sheet S gets under the arm portion 16*c* along the movable guide 18 and then reaches the downstream side conveyance guide portion 15*b*.

Figure 7C:
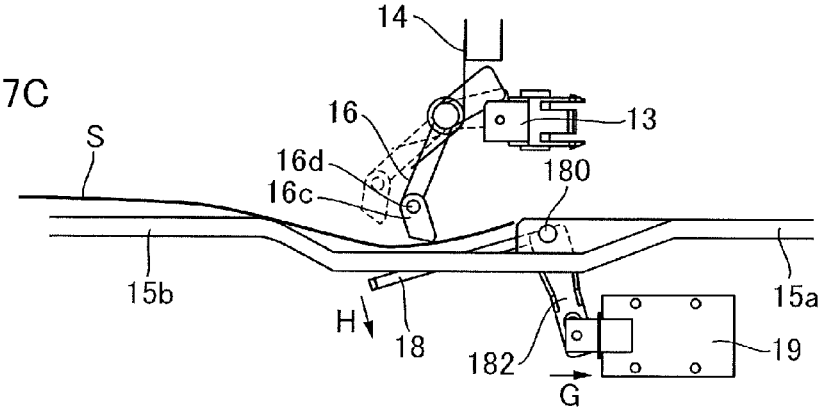
FIG. 7C is a side view illustrating a state in which a movable guide is pivoted downwardly by a solenoid.

Next, for example, as illustrated in FIG. 7C, if the sheet rear end is separated from the upstream side conveyance guide portion 15*a* and then reaches the movable guide 18, the control portion 100 turns on the solenoid 19 such that the movable guide 18 is pivoted downwardly as indicated by an arrow H. If the movable guide 18 is pivoted downwardly, the sheet lower surface is not supported around the detection flag 16, and thus the detection flag 16 is moved from the detection position to the home position side by a biasing force of the biasing member 14 while the arm portion 16*c* pushes down the sheet S. In other words, in the present embodiment, the movable guide 18 is pivoted downwardly by the solenoid 19 before the sheet rear end passes through the detection flag 16, and thus the detection flag 16 is moved from the detection position to the home position side.

Figure 7D:
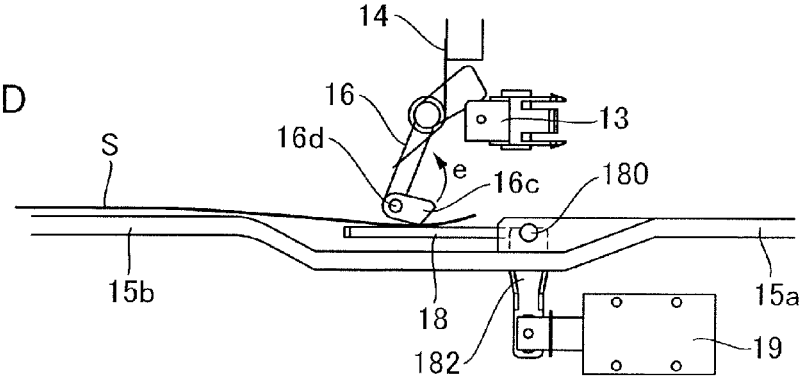
FIG. 7D is a side view illustrating a state in which the movable guide has returned to an original position by tuning off the solenoid.

Then, the solenoid 19 is turned off at a predetermined timing before the sheet rear end passes through the detection flag 16, and the movable guide 18 returns to the original position as illustrated in FIG. 7D. If the movable guide 18 returns to the original position as mentioned above, the movable guide 18 pushes the arm portion 16*c* of the detection flag 16 via the sheet S, and thus the arm portion 16*c* is pivoted in the arrow e direction. If the sheet has passed, the arm portion 16*c* is rotated by gravity and returns to the original position as illustrated in FIG. 7A.

As described above, in the present embodiment, before the sheet rear end passes through the detection flag 16, the movable guide 18 is pivoted downwardly by using the solenoid 19, and thus the detection flag 16 is moved to the home position side in advance. Consequently, in the same manner as in the above-described first embodiment, it is possible to reduce the time required for the detection flag to return to the home position after the sheet rear end passes through the detection flag more than in the related art.

Figure 8:
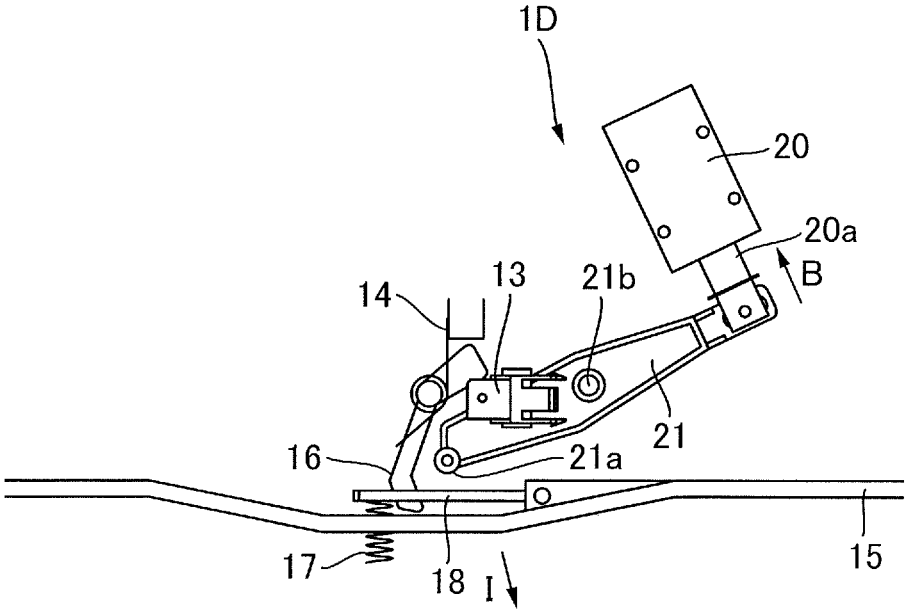
FIG. 8 is a diagram illustrating a configuration of a sheet detection portion provided in a sheet conveying apparatus according to a fourth embodiment of this disclosure.

Next, a fourth embodiment of this disclosure will be described. FIG. 8 is a diagram illustrating a configuration of a sheet detection portion 1D provided in a sheet conveying apparatus according to the present embodiment. In FIG. 8, the same reference numerals indicate similar or corresponding portions in FIGS. 3A to 3D described above.

In FIG. 8, the reference numeral 21 indicates a pushing member as a pushing portion which is provided to oppose the movable guide 18 and pushes and pivots the movable guide 18 downwardly. The pushing member 21 swings with a pivotal shaft 21*b* as a supporting point, and a rolling member 21*a* is rotatably provided at a distal edge portion thereof. The reference numeral 20 indicates a solenoid, and a pin 20*a* of the solenoid 20 is connected to the other end of the pushing member 21. When the sheet S passes through the movable guide 18, the control portion 100 turns on the solenoid 20. Consequently, the pin 20*a* is moved in an arrow B direction, and thus the pushing member 21 swings with the pivotal shaft 21*b* as a supporting point. Therefore, the rolling member 21*a* is lowered and pushes the movable guide 18 downwardly via the sheet S, that is, in a direction becoming distant from the detection flag 16 such that the movable guide 18 is pivoted downwardly.

Figure 9A:
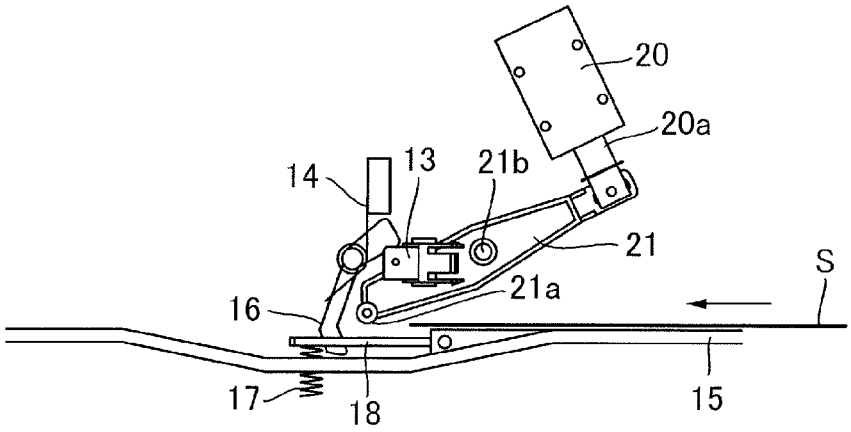
FIG. 9A is a side view illustrating a state in which the sheet is conveyed toward the sheet detection portion.
Figure 9B:
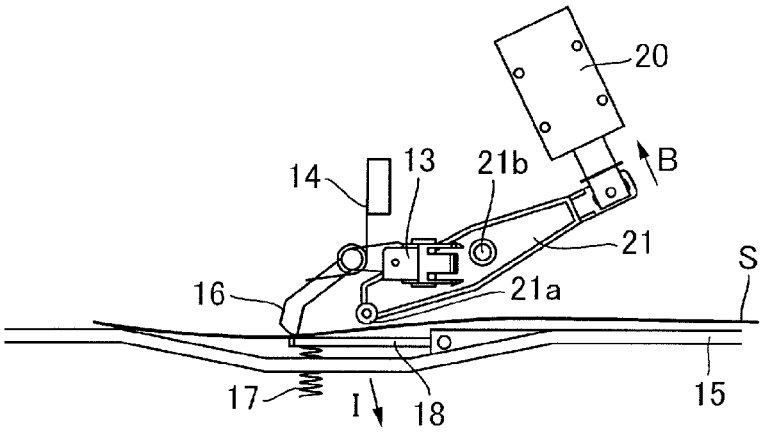
FIG. 9B is a side view illustrating a state in which a detection flag is rotated by the conveyed sheet.
Figure 9C:
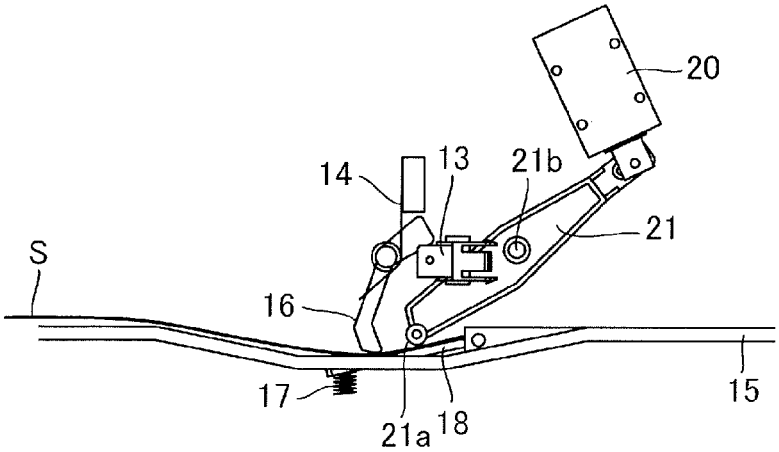
FIG. 9C is a side view illustrating a state in which the movable guide is pivoted downward by a pushing member.

Next, a description will be made of a sheet detection operation in the sheet detection portion 1D having the configuration with reference to FIGS. 9A to 9C. FIG. 9A illustrates a state in which the sheet S has not yet reached the sheet detection portion 1D, and, at this time, the detection flag 16 lies at the home position. The pushing member 21 is located at the home position over the movable guide 18. Next, if the sheet S reaches the sheet detection portion 1D, the detection flag 16 is moved by the front end of the sheet to the detection position, while resisting against a biasing force of the biasing member 14. If the sheet S is further conveyed, the sheet S is conveyed while getting under the detection flag 16 as illustrated in FIG. 9B.

Next, if the control portion 100 turns on the solenoid 20, and thus the pin 20*a* is moved in an arrow B direction, the pushing member 21 swings in a counterclockwise direction indicated by an arrow I with the pivotal shaft 21*b* as a supporting point. Consequently, as illustrated in FIG. 9C, the movable guide 18 is pushed downwardly along with the sheet S while resisting against a biasing force of the biasing member 17, and the detection flag 16 is moved from the detection position to the home position side.

In other words, in the present embodiment, the movable guide 18 is pivoted downwardly by the solenoid 20 before the sheet rear end passes through the detection flag 16, and thus the detection flag 16 is moved from the detection position to the home position side, that is, in the direction becoming distant from the detection flag 16. When the movable guide 18 is pivoted downwardly by the pushing member 21, the pushing member 21 comes into pressure contact with the sheet S from the upper side. However, since the rolling member 21*a* of the pushing member 21 comes in contact with the sheet S, there is no resistance in conveyance of the sheet S. If the rear end of the sheet S has passed, the solenoid 20 is turned off, and thus the pushing member 21 returns to the original position illustrated in FIG. 9A described above. In this case, the magnitude of biasing forces of the two biasing members 14 and 17 is set such that the movable guide 18 does not push up the detection flag 16 via the sheet S.

As described above, in the present embodiment, before the sheet rear end passes through the detection flag 16, the movable guide 18 is pivoted downwardly by using the solenoid 20 and the pushing member 21, and thus the detection flag 16 is moved to the home position side in advance. Consequently, in the same manner as in the above-described first embodiment, it is possible to reduce the time required for the detection flag to return to the home position after the sheet rear end passes through the detection flag more than in the related art.

Figure 10:
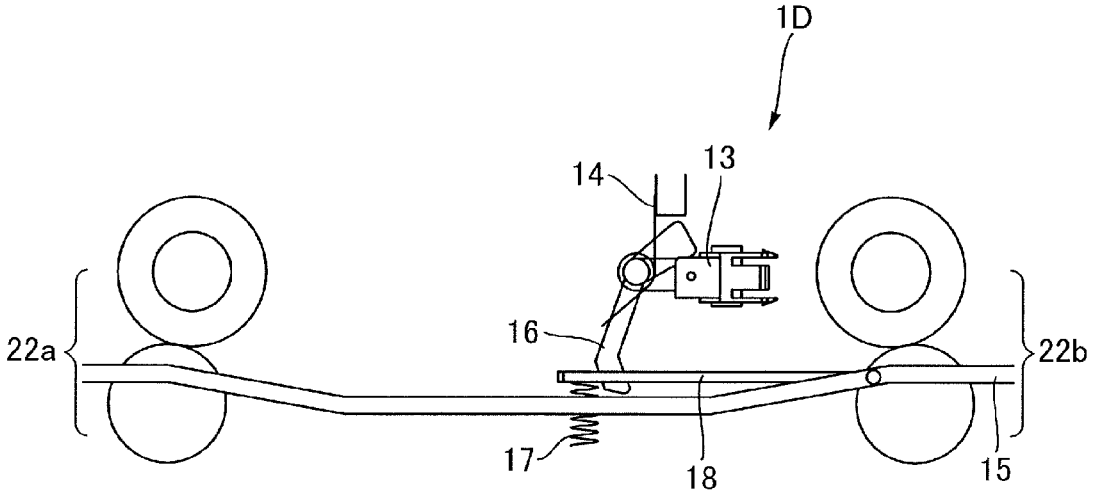
FIG. 10 is a diagram illustrating a configuration of a sheet detection portion provided in a sheet conveying apparatus according to a fifth embodiment of this disclosure.

Next, a fifth embodiment of this disclosure will be described. FIG. 10 is a diagram illustrating a configuration of a sheet detection portion 1D provided in a sheet conveying apparatus according to the present embodiment. In FIG. 10, the same reference numerals indicate similar or corresponding portions in FIGS. 3A to 3D described above.

In FIG. 10, the reference numeral 22*a* indicates a first conveyance roller pair which is provided on the downstream side of the sheet detection portion 1D in the sheet conveyance direction, and the reference numeral 22*b* indicates a second conveyance roller pair which is provided on the upstream side of the sheet detection portion 1D in the sheet conveyance direction. Here, in the present embodiment, the second conveyance roller pair 22*b* which is a first rotating body pair is disposed such that the sheet conveyance direction is a direction in which the sheet S comes close to the conveyance guide 15. The first conveyance roller pair 22*a* which is a second rotating body pair is disposed such that the sheet conveyance direction is a direction in which the sheet S becomes distant from the conveyance guide 15.

A sheet conveyance speed of either the first conveyance roller pair 22*a* or the second conveyance roller pair 22*b* is variable such that the sheet S is deflected between the first conveyance roller pair 22*a* and the second conveyance roller pair 22*b*. In the present embodiment, a sheet conveyance speed of the second conveyance roller pair 22*b* is variable.

Figure 11A:
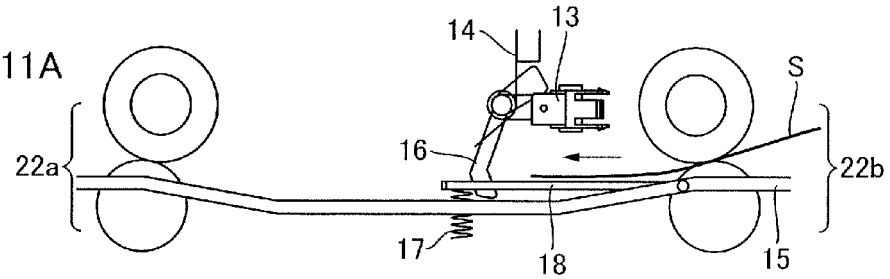
FIG. 11A is a side view illustrating a state in which the sheet is conveyed toward the sheet detection portion.
Figure 11B:
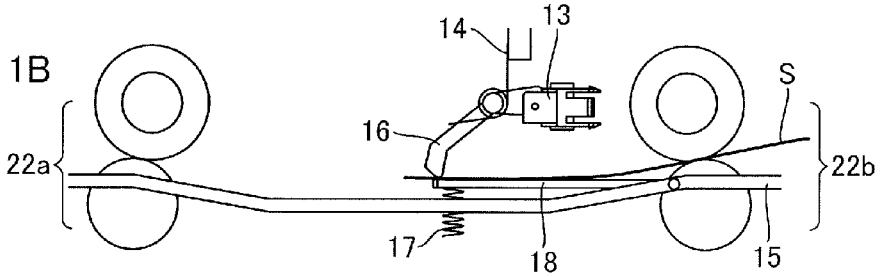
FIG. 11B is a side view illustrating a state in which a detection flag is rotated by the conveyed sheet.

Next, a description will be made of a sheet detection operation in the sheet detection portion 1D having the configuration with reference to FIGS. 11A to 11D. FIG. 11A illustrates a state in which the sheet S has not yet reached the sheet detection portion 1D, and, at this time, the detection flag 16 lies at the home position. In addition, at this time, the sheet S is conveyed in a direction coming close to the conveyance guide 15 by the second conveyance roller pair 22*b*. If the sheet S reaches the sheet detection portion 1D, the detection flag 16 is moved to the detection position by the front end of the sheet, and then the sheet S is conveyed while getting under the detection flag 16 as illustrated in FIG. 11B.

Figure 11C:
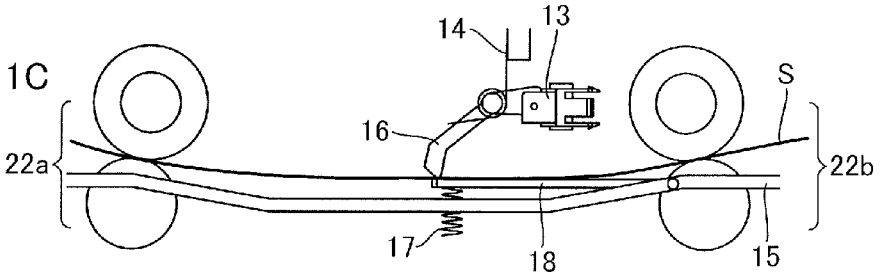
FIG. 11C is a side view illustrating a state in which a front end of the sheet reaches a nip portion of a first conveyance roller pair.
Figure 11D:
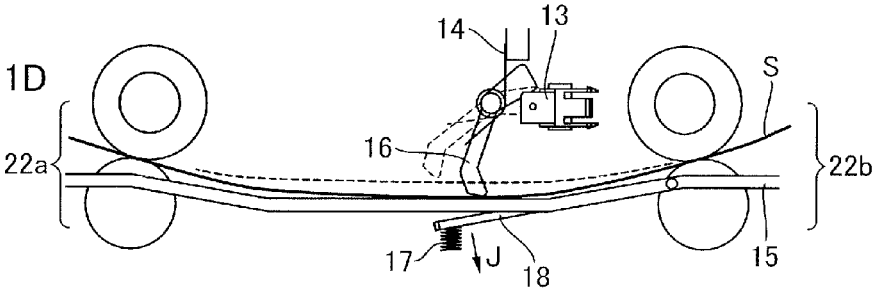
FIG. 11D is a side view illustrating a state in which the sheet is deflected by a difference in a sheet conveyance speed between first and second conveyance roller pairs.

If the sheet S is further conveyed, the sheet S reaches the first conveyance roller pair 22*a* as illustrated in FIG. 11C. If the sheet reaches the first conveyance roller pair 22*a*, the control portion 100 increases a rotation speed of the second conveyance roller pair 22*b* so as to increase a sheet conveyance speed. Consequently, a difference in the sheet conveyance speed between the first and second conveyance roller pairs 22*a* and 22*b* occurs, and the sheet S is deflected downwardly due to the difference in the sheet conveyance speed as illustrated in FIG. 11D such that the movable guide 18 is pushed down in a direction indicated by an arrow J. Therefore, the detection flag 16 which is in contact with the upper surface of the sheet S is also moved from the detection position to the home position side by a biasing force of the biasing member 14 while pushing down the sheet S.

In other words, in the present embodiment, the movable guide 18 is pivoted downwardly due to a difference between sheet conveyance speeds of the first conveyance roller pair 22*a* and the second conveyance roller pair 22*b* before the sheet rear end passes through the detection flag 16, and thus the detection flag 16 is moved to the home position side. If the rear end of the sheet S has passed, the detection flag 16 and the movable guide 18 return to the home position as illustrated in FIG. 11A described above. In addition, the magnitude of biasing forces of the two biasing members 14 and 17 is set such that the movable guide 18 does not push up the detection flag 16 via the sheet S after the sheet rear end passes through the second conveyance roller pair 22*b*.

As described above, in the present embodiment, the movable guide 18 is pivoted downwardly due to a difference between sheet conveyance speeds before the sheet rear end passes through the detection flag 16, and thus the detection flag 16 is moved to the home position side in advance. Consequently, in the same manner as in the above-described first embodiment, it is possible to reduce the time required for the detection flag to return to the home position after the sheet rear end passes through the detection flag more than in the related art.

It is noted that while the detection flag 16 is moved toward the home position before the rear end of the sheet passes the detection flag 16 by moving the movable guide 18 in the above embodiments, the movable guide 18 is not always necessary. For instance, the pressing force of the detection flag 16 may be set such that the detection flag 16 is held in the detection position by the stuffiness of the sheet when the sheet is supported both of the upstream and downstream conveyance surface of the conveyance guide and moves toward the home position side when the rear end of the sheet reaches the recess portion 15*c*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-076749, filed Apr. 3, 2014, which is hereby incorporated by reference herein in its entirety.

What is claimed is:

1. A sheet conveying apparatus comprising:

a moving member moving from a first position to a second position by being pressed by a conveyed sheet;

a sensor detecting the sheet based on the move of the moving member;

a conveyance guide provided on a side facing the moving member and having a recess portion formed therein;

a support member provided within the recess portion of the conveyance guide, supporting the sheet being conveyed within the recess portion, and being movable from a support position where the support member supports the sheet in a direction approaching the conveyance guide; and a bias member biasing the support member toward the support position and having a bias force smaller than a force of the moving member pressing the support member, wherein the moving member enters the recess portion in the first position, and wherein the moving member moves in a direction approaching the first position from the second position before a rear end of the sheet passes the moving member after moving from the first position to the second position by being pressed by the sheet.

2. The sheet conveying apparatus according to claim 1, wherein the moving member moves in a direction approaching the first position from the second position when a rear end of the sheet passes the recess portion.

3. The sheet conveying apparatus according to claim 1, wherein in the second position the moving member is retracted from the recess portion.

4. The sheet conveying apparatus according to claim 3, wherein the support member moves in the direction approaching the conveyance guide during the sheet passing the moving member and before when the rear end of the sheet passes the moving member.

5. The sheet conveying apparatus according to claim 4, wherein the support member includes a notch through which the moving member passes when the moving member moves to the first position, and wherein the support member is pressed in the direction approaching the conveyance guide through the sheet by the moving member that has moved to the second position before the rear end of the sheet being conveyed passes the moving member.

6. The sheet conveying apparatus according to claim 3, further comprising:

a cam mechanism moving the support member in linkage with the move of the moving member, the cam mechanism moving the support member in the direction approaching the conveyance guide from the support position before a front end of the sheet being conveyed passes the moving member.

7. The sheet conveying apparatus according to claim 3, further comprising a solenoid moving the support member in the direction approaching the conveyance guide from the support position.

8. The sheet conveying apparatus according to claim 3, further comprising:

a press member provided to face the support member and movable to a position pressing the support member in the direction approaching the conveyance guide from the support position; and a solenoid moving the press member to the position pressing the support member.

9. The sheet conveying apparatus according to claim 3, further comprising:

a first rotator pair conveying a sheet; and a second rotator pair provided at upstream, in a sheet conveying direction, of the first rotator pair:

wherein a sheet conveying speed of the second rotator pair is set to be faster than a sheet conveying speed of the first rotating body pair such that the sheet is deflected and the support member is pressed in the direction approaching the conveyance guide from the support position through the deflected sheet before the rear end of the sheet being conveyed passes the moving member.

10. The sheet conveying apparatus according to claim 1, wherein the moving member is held at the first position by being abutted against a stopper.

11. An image forming apparatus comprising:

an image forming portion; and the sheet conveying apparatus according to claim 1 conveying a sheet.

* * * * *